US006643950B2

(12) United States Patent
Lambert et al.

(10) Patent No.: US 6,643,950 B2
(45) Date of Patent: Nov. 11, 2003

(54) SYSTEM AND METHOD FOR MEASURING FREEZE DRIED CAKE RESISTANCE

(75) Inventors: William J. Lambert, Raleigh, NC (US); Zeren Wang, Apex, NC (US)

(73) Assignee: Eisai Co., Ltd., Tokyo (JP)

( * ) Notice: Subject to any disclaimer, the term of this patent is extended or adjusted under 35 U.S.C. 154(b) by 67 days.

(21) Appl. No.: 10/006,015

(22) Filed: Dec. 4, 2001

(65) Prior Publication Data

US 2002/0121099 A1 Sep. 5, 2002

Related U.S. Application Data

(60) Provisional application No. 60/251,672, filed on Dec. 6, 2000.

(51) Int. Cl.[7] ..... F26B 5/06

(52) U.S. Cl. ..... 34/286; 34/92; 34/287; 34/409; 34/570

(58) Field of Search ..... 34/285, 286, 287, 34/402, 406, 409, 89, 92, 570; 73/38, 31.04, 863.02

(56) References Cited

U.S. PATENT DOCUMENTS

| | | | | |
|---|---|---|---|---|
| 3,192,643 A | | 7/1965 | Rieutord | 34/565 |
| 3,271,874 A | | 9/1966 | Oppenheimer | 34/292 |
| 4,514,603 A | * | 4/1985 | Staples | 200/61.6 |
| 4,521,628 A | * | 6/1985 | Ostermaier | 568/1 |
| 5,637,754 A | * | 6/1997 | Rijkers et al. | 560/41 |
| 6,122,836 A | * | 9/2000 | Tenedini et al. | 34/92 |

FOREIGN PATENT DOCUMENTS

| | | |
|---|---|---|
| DE | 33 11 525 | 10/1984 |
| DE | 43 39 589 | 12/1994 |
| GB | 1 587 409 | 4/1981 |

* cited by examiner

*Primary Examiner*—Tra S. Lazarus
*Assistant Examiner*—Kathryn S. O'Malley
(74) *Attorney, Agent, or Firm*—Hale and Dorr LLP

(57) ABSTRACT

A cake resistance measuring system and method are used to measure the cake resistance of a freeze dried sample during or after processing, with the results of the measurement being used to improve that processing and/or subsequent freeze drying processes or formulations.

19 Claims, 2 Drawing Sheets

SYSTEM AND METHOD FOR MEASURING FREEZE DRIED CAKE RESISTANCE

FIELD OF THE INVENTION

This invention relates to the process of lyophilization, also called freeze drying, of pharmaceutical drugs and biologicals.

BACKGROUND OF THE INVENTION

Generally, lyophilization, or freeze drying, is a process that extracts water from a compound so that the compound remains stable and can be stored at ambient air temperature. In the pharmaceutical industry, it is known to freeze dry drugs and biologicals to maintain the stability of these drugs and biologicals at room temperature over a long period of time. In the manufacture of pharmaceutical drugs and biologicals, the freeze drying process usually takes place in vials in a freeze drying chamber. Hundreds or thousands of vials can be freeze dried at the same time in a production run in a freeze drying chamber that can be refrigerator size or even room size. One example of a freeze drying chamber for holding many vials is shown in U.S. Pat. No. 5,421,686.

Low temperature is applied to the vials to freeze the moisture (or other solvents) in the drugs or biologicals to produce ice, and then low pressure is applied to effect sublimation of the ice; that is, the ice passes from a solid phase directly to a gas phase without an intermediate liquid phase. This is referred to as the primary drying stage. The gas is then exhausted from the chamber.

As the sublimation of the ice proceeds, a dried product layer (referred to as a "cake") is produced above the ice. This product resists the diffusion of moisture generated from the ice beneath it during freeze drying. This resistance (referred to here as "cake resistance") can be a useful parameter to know for optimizing the freeze drying process. A high cake resistance can slow manufacturing significantly, and may even cause product collapse. Efficiency is important because the process is time-consuming and it is desirable to run the manufacturing equipment at all times if possible.

Two methods have been proposed to determine the cake resistance. In a microbalance method, cake resistance is measured during freeze-drying in a specialized microbalance. Pikal et al., "Physical Chemistry of Freeze-drying: Measurement of Sublimation Rates for Frozen Aqueous Solutions by a Microbalance Technique," Journal of Pharmaceutical Sciences, 72 (1985) 635–650. The microbalance is shown in FIG. 2 of the article. The method described in Pikal et al. is not necessarily accurate for a production sample, however, because there are differences between the conditions in the microbalance and those in the manufactured products in a production run.

In another method, cake resistance is estimated using an indirect method which calculates the resistance as a parameter in a mathematical model. Milton et al., "Evaluation of Mamometric Temperature Measurement as a Method of Monitoring Product Temperature During Lyophilization," PDA Journal of Pharmaceutical Science & Technology, 51(1997), 7–16. Since the resistance is not determined directly in this case, the result may not be reliable for optimizing the freeze drying process.

It is a continuing goal in pharmaceutical manufacturing to improve the efficiency of the lyophilization process.

SUMMARY OF THE INVENTION

The present invention includes a system and method for measuring cake resistance in a production sample of a product during or after the freeze drying process. The results of the cake resistance measurement can be used to change the freeze drying parameters, such as temperature and/or pressure, to optimize the process to reduce this cake resistance in future processes, and/or to change the composition that is being freeze dried in future processes. By introducing a gas with a controlled pressure or flow (volume per unit of time), it is possible to determine cake resistance by measuring a resulting gas flow or pressure, respectively, from one of a number of production products.

In another aspect, the invention includes a freeze drying system and method with a cake resistance measuring system and feedback for controlling parameters of the freeze drying process during processing. This allows the system to monitor the resistance and alter the temperature and/or pressure during the processing.

In yet another aspect, the invention includes a freeze drying system and method whereby cake resistance is measured through the application of a controlled flow or pressure of gas through multiple tubes to multiple samples. The tubes are located at different depths in the products being measured. By measuring the cake resistance with tubes at different depths into the products being freeze dried, a useful understanding about the manufacturing process can be obtained and used to control the parameters of the freeze drying process in real time or for subsequent processing. The measurements can be taken during or after freeze drying.

This device permits one to determine the cake resistance of a freeze dried product directly from a production sample while the freeze drying is taking place or soon thereafter, rather than in a specialized device or through an indirect estimation method, and to use the results to monitor and preferably improve the freeze drying process in real time or subsequently. Such an improvement is useful and important in large scale freeze drying where equipment is used as continuously as possible. Other features and advantages will become apparent from the following detailed descriptions, drawings, and claims.

DETAILED DESCRIPTION

Figure 1:
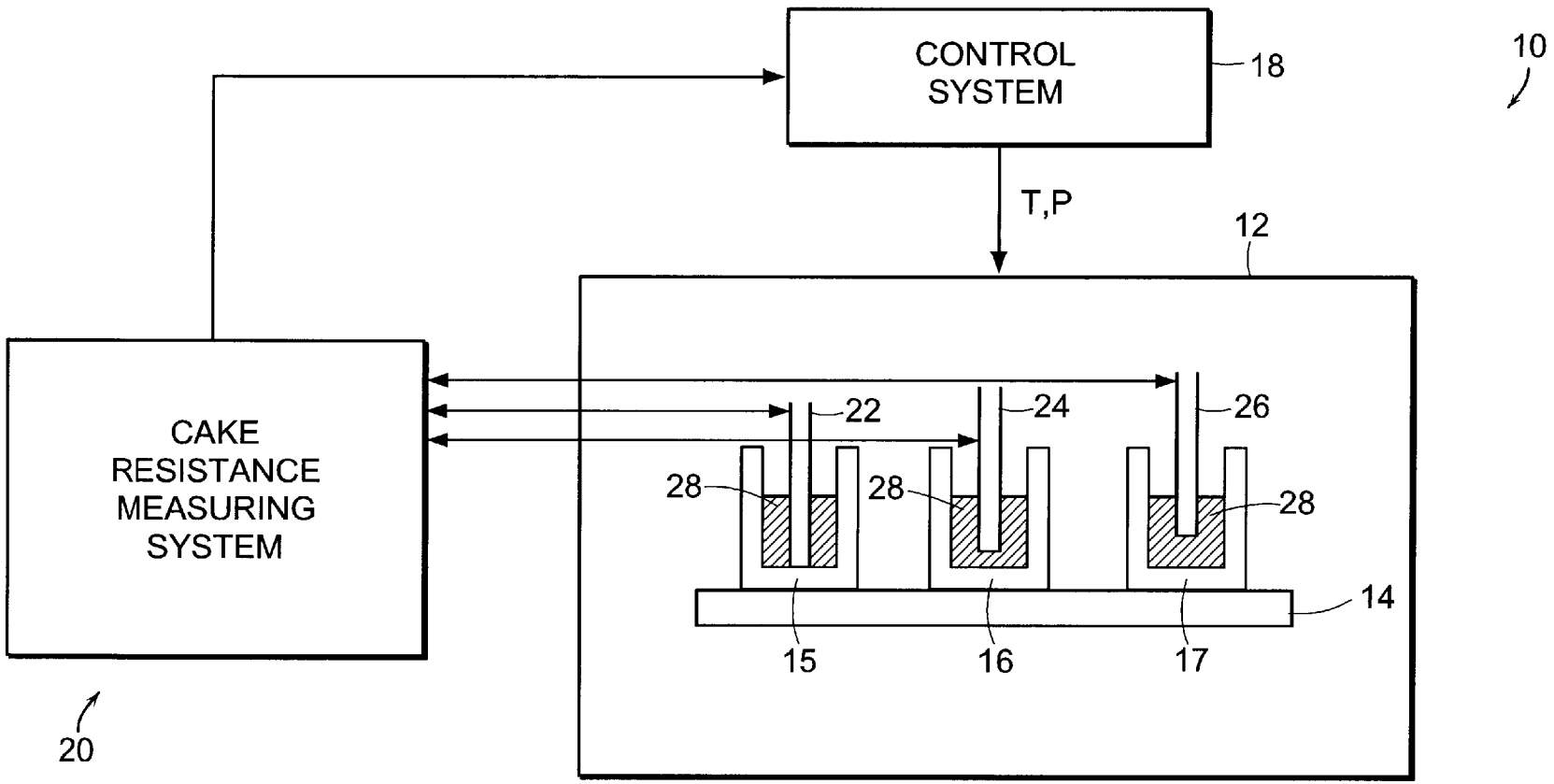
FIG. 1 is a block diagram of a freeze drying system process as implemented in this invention.

Referring to FIG. 1, a lyophilization or freeze drying system 10 has a vacuum chamber 12 with a shelf 14 for holding vials 15, 16, and 17. The vials hold the compounds being freeze dried. For convenience, only one shelf and three vials are shown, but in a typical production run, there would be a much larger number of shelves holding hundreds, thousands, or even tens of thousands of vials.

A control system 18 with appropriate refrigeration cycle equipment controls the pressure and temperature conditions in chamber 12 based on parameters entered by a user. For example, shelf 14 may have a controllable temperature for assisting with the freezing. The control system can, for example, step the temperature down to a low temperature, lower the pressure, and then step the temperature and pressure back up. This process causes the ice to form, and then causes the sublimation of that ice with the resulting gas exhausted from the chamber. The control system can include temperature control systems (compressors, condensers, etc.), a vacuum pump, and general purpose or specialty processing, such as a microprocessor, application-specific integrated circuit (ASIC), or programmable logic (e.g., PLD or PAL). Such control of the temperature and pressure in a freeze drying chamber is generally known.

A cake resistance measuring system shown generally at 20 includes one or more tubes inserted into vials to measure cake resistance of an actual product 28 in chamber 12 as described in more detail below. The results from measuring system 20 can be used to provide control signals to control system 18 to cause the control system to make modifications to the process depending on the results of the cake resistance measurement. This connection may be direct from sensing equipment in the measuring system, or may have intermediate intervention between monitoring the cake resistance and altering parameters.

As shown in FIG. 1, there are three vials 15, 16, and 17, each of which holds a product 28 being freeze dried. The cake resistance measuring system includes tubes 22, 24, and 26 in respective vials 15, 16, and 17. The tubes are inserted into the product at different depths to obtain additional information about the freeze drying process, and, if conducted during the processing of the samples, to monitor changes at multiple depths in the device.

Figure 2:
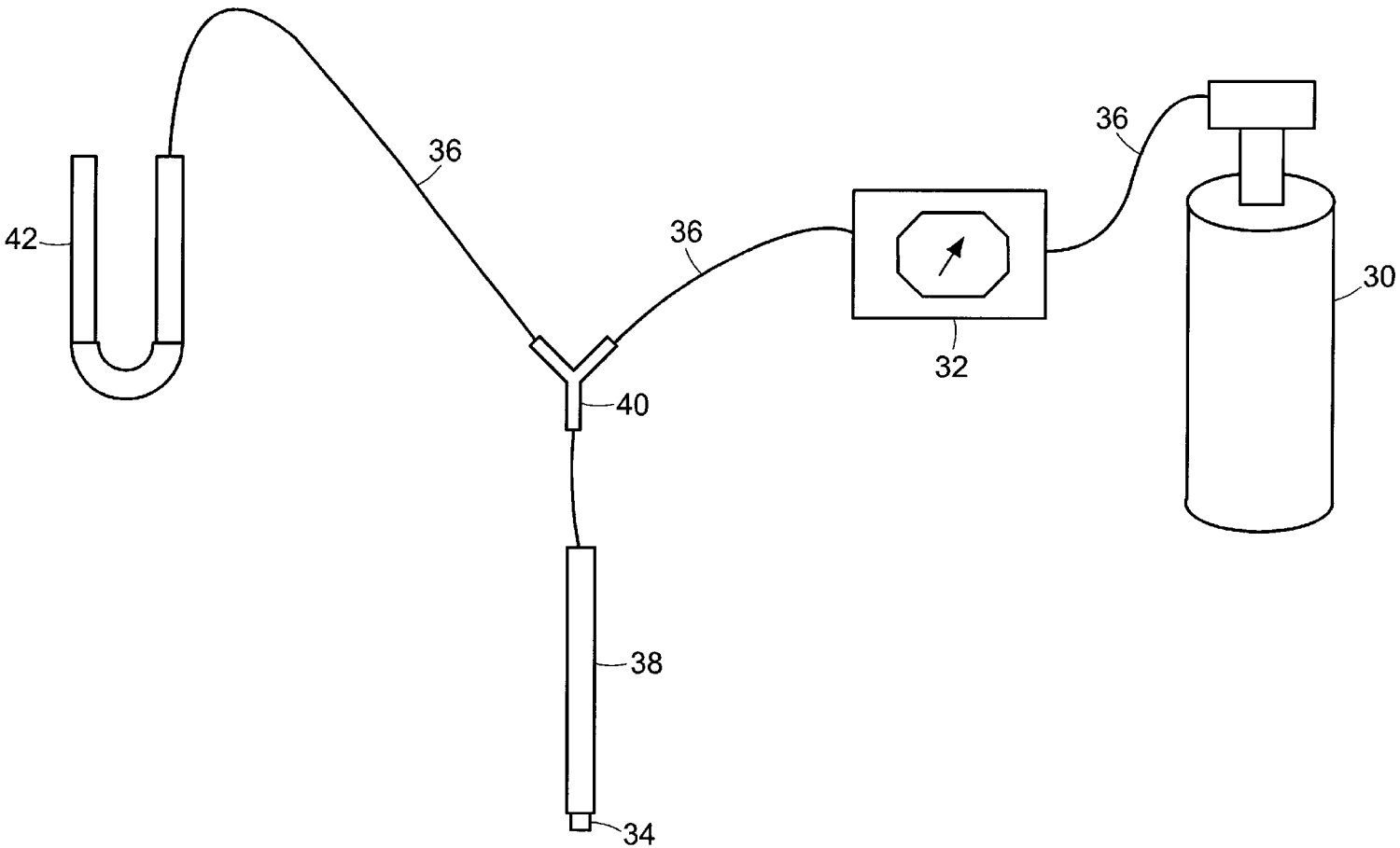
FIG. 2 is an overview of a testing device providing a controlled volume and measuring pressure.

FIG. 2 shows an embodiment of a cake resistance measuring system according to the present invention. A gas is flowed to a sample in a vial with a production sample to measure the cake resistance. A source 30 with controlled pressure provides a flow of a gas through a sensor 32 which measures and controls the flow of the gas from source 30. This constant flow of gas is applied to a sample 34 through conduits 36 and a tube 38. The sample is taken from one of a large number of vials during or after lyophilization, i.e., from one of many actual products and not a specialized device.

Tube 38 and conduits 36 are connected with a y-shaped connector 40. Connector 40 allows the flow of gas to come in on one side and exit from the other side, where connector 40 is then coupled to a pressure sensor 42. Sensor 42 can take different forms but is shown here as a water-filled U-shaped pressure gauge for measuring the change of pressure as a result of the flow of gas applied to sample 34. Tube 38 is preferably clear and made of glass or plastic. Tube 38 with the sample plug may be removed from the sample before measurement, but the freeze drying can occur with the tube in place. The gas is preferably inert; preferred gases that can be used include nitrogen ($N_2$), helium (He), and dried air. For examples of dimensions, a vial can be about 2.5–5 cm in diameter (1–2 inches), the product about 1–2.5 cm (0.4–1 inch) in thickness, and the tube a capillary tube about 1–2 mm (40–80) mils) in diameter.

The cake resistance is a function of (1) the pressure across sample plug 34, (2) the flow rate of the gas, (3) the length of sample plug 34, and (4) a cross section of sample plug 34 (which is also the inner area of tube 38). Because the pressure and flow are measured by sensors 42 and 32, respectively, and the length and cross sectional area of the plug are geometric properties known in advance, the cake resistance can be determined from these measured and known parameters.

The sensors can effectively be reversed such that one sensor monitors and keeps constant the pressure of a gas coming from the source. This constant pressure is applied to the sample through a plastic tube and the flow of the gas is measured with a second sensor.

Once the cake resistance is determined by one of the methods above, the result can be used to change the parameters of future freeze-drying processes, e.g., by changing the temperature and/or pressure as provided by the control system (FIG. 1). Alternatively, the results of the cake resistance measurements can be used to change the formulation of the composition being manufactured to obtain a desired cake resistance, or the results can be used to change both the formulation and the parameters of freeze drying.

As indicated in FIG. 1, the results of the cake resistance can be provided to control system 18 in the freeze drying process in order to control the process as it is occurring, e.g., by reducing pressure or temperature if the resistance is higher than desired, or by increasing pressure if there is low resistance. These different uses of the results can be combined further, for example, by controlling the operating parameters during the processing, and then using the results to change formulation and/or parameters for future processing.

Through experience, it may be determined that providing a tube in a vial during the freeze drying process can alter somewhat the cake resistance relative to other products that do not have a tube inserted during processing. Through measurements of products with tubes inserted during processing and other products measured after processing, compensation factors may be determined to compensate for tubes being inserted during the processing.

As indicated above, multiple tubes can be used at different positions within the product being freeze dried, in which case samples can be taken at one time for multiple depths, over separate times for different depths, or a combination in which the resistance is monitored as a function of time at each depth.

EXAMPLES

The following examples demonstrate cake resistance measurements with the system of the present invention:

Example 1

| | |
|---|---|
| Sample: | 10% disaccharide |
| Plug length: | 0.77 cm |
| Gas used: | Nitrogen ($N_2$) |
| Resistance: | 20.3 mmHg/(ml/min)/cm$^3$ |

The freeze dried disaccharide product is amorphous and typically has high resistance to gas diffusion. The sample was freeze dried in Class 100 conditions (a very clean environment). The ice crystals of the sample may be small during freeze drying in such a clean environment and thus leave small pores after the product is freeze dried. Therefore, high resistance to gas diffusion may be generated.

Example 2

| | |
|---|---|
| Sample: | 10% disaccharide |
| Plug length: | 0.69 cm |
| Gas used: | Nitrogen ($N_2$) |
| Resistance: | 7.7 mmHg/(ml/min)/cm$^3$ |

This sample was freeze dried in a laboratory environment. The dust in the air can act as a nucleus for ice formation, thus generating large ice crystals during freeze drying, and leaving large holes in a freeze dried product. Consequently, the resistance to gas diffusion is smaller than under the conditions of Example 1. The difference in cake resistance between Examples 1 and 2 reflects the difference between class 100 conditions and a laboratory environment.

The high resistance to gas diffusion in a product often causes prolonged freeze drying time. The freeze drying time in the primary drying stage for the sample in Example 1 was about 80 hours, while the comparable time for the sample in Example 2 was about 24 hours, with similar freeze drying condition in both cases.

Example 3

| | |
|---|---|
| Sample: | 2.5% Mannitol |
| Plug length: | 1.08 cm |
| Gas used: | Nitrogen ($N_2$) |
| Resistance: | 1.8 mmHg/(ml/min)/cm$^3$ |

Since mannitol is crystalline after being freeze dried, the ice crystals are usually large during a freeze drying process. Therefore, large holes are formed in a freeze dried product, and the resistance to gas is low. The cake resistance result from Example 3 is much lower than the results from Examples 1 and 2, consistent with the formation of large ice crystals during freeze drying.

Having described embodiments in the present invention, it should be apparent that modifications can be made without departing from the scope of the invention as defined by the appended claims. For example, other types of sensors, gases, and tubes can be used.

What is claimed is:

1. A method for determining cake resistance of a product during or after freeze drying including:

introducing a gas to a sample of one of a large number of products in a freeze drying production run; and measuring a change in one of flow and pressure of the gas from the product sample to derive cake resistance.

2. The method of claim 1, wherein a constant flow of gas is provided to the sample and a change in pressure is sensed.

3. The method of claim 1, further comprising reformulating the product in a future processing of products to reduce the cake resistance in response to the cake resistance measurement.

4. The method of claim 1, further comprising modifying the temperature and/or pressure during a future processing in response to the cake resistance measurement.

5. The method of claim 1, further comprising modifying the temperature and/or pressure during the processing in response to the cake resistance measurement.

6. The method of claim 5, wherein the modifying includes altering the temperature and/or pressure if the cake resistance is higher than desired.

7. The method of claim 1, wherein gas at a constant pressure is provided to the sample and a change in flow is sensed.

8. An apparatus for determining cake resistance during or after lyophilization comprising:

a source of gas;

a device controlling the flow of gas to obtain one of constant pressure and constant flow;

a tube for taking a sample from one of a large number of production samples of a product; and a sensor for measuring a change in the other of flow and pressure of the gas provided to the sample.

9. The apparatus of claim 8 wherein the controlling device includes a flow meter for providing a source of constant flow from the source, and the sensor includes a sensor for measuring the gas pressure from the sample of gas.

10. The apparatus of claim 9, further comprising conduits for fluidly coupling the source, flow meter, sensor, and tube.

11. The apparatus of claim 8, further comprising a vacuum chamber, vials for holding the products, and racks for holding the vials.

12. The apparatus of claim 11, further comprising a control system for controlling pressure and/or temperature in the vacuum chamber.

13. The apparatus of claim 12, wherein the sensor is operatively coupled to the control system to alter the pressure and/or temperature in response to the sensed pressure.

14. A method comprising measuring cake resistance of one of a number of products in a production run undergoing lyophilization and changing the parameters of the lyophilization process to alter the lyophilization process during the production run.

15. The method of claim 14, wherein the lyophilization is done in a chamber, and wherein the changing includes reducing the temperature in a chamber with the production run if the cake resistance is higher than desired.

16. The method of claim 14, wherein the lyophilization is done in a chamber, and wherein the changing includes reducing the pressure in a chamber with the production run if the cake resistance is higher than desired.

17. A method for measuring cake resistance in a freeze dried product comprising:

inserting into a plurality of different freeze dried products a tube inserted to a different depth for each of the products;

introducing one of a controlled flow or pressure of gas into each of the tubes;

measuring the other of pressure and flow of the introduced gas; and using the multiple tubes at different locations within the products to monitor the cake resistance at different positions within the product.

18. The method of claim 17, wherein the measurements of cake resistance are taken at one or more times during processing.

19. The method of claim 17, wherein the cake resistance measurements are made after the products have been completely freeze dried.

* * * * *